US005138924A

United States Patent [19]

Ohya et al.

[11] Patent Number: 5,138,924

[45] Date of Patent: Aug. 18, 1992

[54] ELECTRONIC MUSICAL INSTRUMENT UTILIZING A NEURAL NETWORK

[75] Inventors: Kenichi Ohya; Junichi Fujimori; Kazuhiko Shutoh, all of Hamamatsu, Japan

[73] Assignee: Yamaha Corporation, Hamamatsu, Japan

[21] Appl. No.: 565,263

[22] Filed: Aug. 9, 1990

[30] Foreign Application Priority Data

Aug. 10, 1989 [JP] Japan ..... 1-209299
Jan. 25, 1990 [JP] Japan ..... 2-15335
Jan. 25, 1990 [JP] Japan ..... 2-15336

[51] Int. Cl.[5] ..... G10H 1/08; G10H 1/18; G10H 7/00

[52] U.S. Cl. ..... 84/604; 84/615; 84/658; 84/660; 84/696

[58] Field of Search ..... 84/603-620, 84/622-638, 649-669, 671-690, 692-717

[56] References Cited

U.S. PATENT DOCUMENTS 4,539,882 9/1985 Yuzawa ..... 84/610
4,736,663 4/1988 Wawrzynek et al. ..... 84/627

OTHER PUBLICATIONS

Laden, Bernice et al., "The Representation of Pitch in a Neural Net Model", Computer Music Journal vol. 13, No. 4 Winter 1989, pp. 12-26.

Todd, Peter M. "A Connectionist Approach to Algorithmic Composition", Computer Music Journal vol. 13, No. 4 Winter 1989, pp. 27-43.

"An Approach to Music Arrangement Using Neural Network" 1989 Spring National Convention Record, The Institute of Electronics, Information and Communication Engineers.

Robert S. Moog, "A Transistorized Theremin," *Electronics World*, vol. 65, No. 1, Jan. 1961, pp. 29-32 and 125, Class 84-672.

*Primary Examiner*—Stanley J. Witkowski
*Attorney, Agent, or Firm*—Spensley Horn Jubas & Lubitz

[57] ABSTRACT

A musical tone parameter generating method and a musical tone generating device of this invention feature that when data inputted by a player is inputted into a neural network as input pattern, the neural network infers the parameters necessary to specify a musical tone wave form to be formed. This makes it possible to get parameters other than those stored in a memory by inferring, which increases variation of the musical tone to be generated.

12 Claims, 13 Drawing Sheets

ELECTRONIC MUSICAL INSTRUMENT UTILIZING A NEURAL NETWORK

BACKGROUND OF THE INVENTION

1. Field of the Invention

This invention relates to an electronic musical instrument which generates parameters specifying a musical tone wave form and controlling a musical tone wave form generation with the aid of a neural network.

2. Description of the Prior Art

The parameters to control the musical tone in the electronic musical instrument are a wave form data which specifies the wave form of the musical tone, an envelope data which specifies an output level of the musical tone wave form, a pitch data which specifies a tone pitch, etc. Several musical tone parameters are stored in a memory of the electronic musical instrument, and can be freely read by a player to play, varying expression. A part of the musical tone parameters is previously stored in the memory of the musical instrument before shipping thereof, and remaining another part of the musical tone parameters can be stored in the memory before the player plays the instrument.

The musical tone parameters stored in the memory in advance can be freely selected for playing by the player while playing the instrument. However, the parameters not stored in the memory cannot be selected. It takes too much time to set new parameters while the player plays the musical instrument, so that this setting was impractical. As a result of this the parameter selection range is too narrow, and play expression is poor.

If more musical tone parameters are stored in the memory for widening the selection range, larger memory is required and it takes much time to store the parameters.

The FM (Frequency Modulation) tone source is one of the conventionally applied tone sources to the electronic musical instrument. The FM tone source synthesize a musical tone by combining (modulating and adding) four or six operators each of which can be set basic wave form (sine wave, triangle wave, etc.), frequency (tone pitch), out put level, envelope, etc. based on a specific algorithm. This tone source can generate beautiful and varied musical tones with simple configuration.

However, it has been regarded that it is difficult to generate the musical tone using the FM tone source according to player's intention. This is mainly due to that it is difficult to predict the change of the musical tone based on the change of the operator and the algorithm since the musical tone is generated by using many parameters and FM modulation.

An example is an electronic musical instrument which is designed to set the pitch of the musical tone to be generated according to ON/OFF pattern of several play keys such as electronic musical wind instrument. Generally, such an electronic musical instrument is provided with a table which stores the pitch data corresponding to several ON/OFF patterns. This table is retrieved according to the ON/OFF pattern by player's operation to find the specific pitch.

In such electronic musical instrument, the ON/OFF pattern of the playing keys can set only the pitch, but the tone color (wave form) of the musical tone was constant irrespective of pitch. In case of natural musical instrument the tone color (wave form) varies delicately depending on the pitch even when the musical instrument (tone color) is the same, and this delicate change of the tone color affects significantly expression of the musical instrument. Moreover, even when the pitch is constant, the tone color changes if fingering pattern is changed. So as to change the tone color as discussed above on the electronic musical instrument, generally, it is necessary to sample the wave form of natural musical instrument for each ON/OFF pattern of the keys and for each pitch and to read out a wave form data. However, these wave form data for each pitch need a large memory capacity to store them, due to which the size of the musical instrument is increased, and its cost rises.

SUMMARY OF THE INVENTION

It is therefore an object of the present invention to provide a musical tone parameter generating method which has solved the above-mentioned problems by generating also the unstored parameters with the aid of a neural network.

The second object of the present invention is to provide an electronic musical instrument which is provided with a musical tone generating device capable of generating easily the musical tone as imaged with the aid of the neural network which infers and outputs the wave form specifying parameters based on several image parameters expressing the features of tone color.

The third object of this invention is to provide an electronic musical tone generating device in which the above-mentioned problems have been solved by inferring and setting the wave form with the aid of the neural network.

The musical tone parameter generating method of this invention features that the neural network learns the input pattern and the musical tone parameter of an expected output which correspond to each other. Because such a neural network is provided, any value other than that of the musical tone parameter stored previously in the memory can be got freely, which enhances expression ability and saving of memory.

The above-mentioned neural network learns several combinations of the input patterns and the musical tone parameter patterns according to an algorithm such as back propagation. Consequently, when the learnt input pattern is inputted, the musical tone parameter pattern corresponding thereto is outputted. Even when any pattern not learnt is inputted, a new musical tone parameter pattern is outputted as a result of associative compensation with the aid of synapse joint of the neural network, which affords possibility of new musical tone expression and enables to save the time for pre-setting the musical tone parameter and the memory to store many musical tone parameters.

The musical tone generating device of this invention functions as follows. Several operators are generated based on several wave form specifying parameters. A musical tone is generated by synthesizing such operators according to a specific algorithm. The wave form specifying parameter for generating the musical tone and the synthesis algorithm are inferred and outputted by the neural network.

Entry for the inference is an image parameter. Applicable image parameters are, for example, tone hardness/softness, showiness/quietness of tone, beauty/dirtiness of tone, thickness/thinness of tone, etc. The neural network learns previously so that the wave form specifying parameter which causing ordinary player's imaging musical tone is outputted. Consequently, proper image parameters input allows of suiting generation musical tone to that image parameters.

Moreover, the electronic musical instrument of this invention features that by inputting the combination (ON/OFF pattern) of play keys into the neural network the data which specifies the wave form of the musical tone is outputted. As the data, the tone color can be inferred and outputted simultaneously in addition to the tone pitch. If this neural network learns, for example, so as to associate tone color change according to the .key ON/OFF pattern of a natural musical instrument, it is possible to infer all tone color patterns of the whole tone range with the aid of one set of synapse weights data. In case of a harmonics synthesis type tone source circuit which is designed so that the musical tone wave form is generated by additively synthesizing a sine wave, the result of Fourrie analysis can be used directly as neural network learning data, if the neural network can output the ratio of harmonics component, thereby facilitating remarkably the embodiment. It is allowed to set also the pitch simultaneously in the neural network. It is also allowed to set the pitch with another means (table, etc.) and to change the frequency of tone color wave which is inferred by the neural network.

DESCRIPTION OF THE PREFERRED EMBODIMENT

Figure 1:
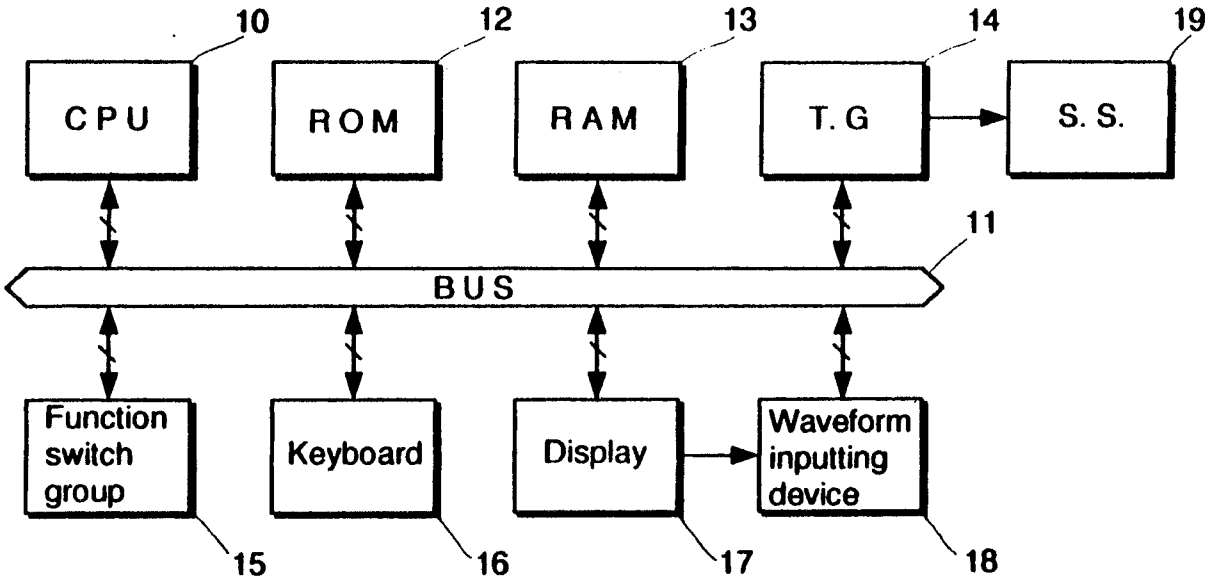
FIG. 1 is a block diagram of control section which is an embodiment of this invention.

FIG. 1 is a block diagram of an electronic musical instrument employing the musical tone parameter generating method which is an embodiment of this invention. This electronic musical instrument is an electronic keyboard type musical instrument having a playing keyboard 16. A tone generator 14 generates the musical tone whose pitch is specified by the playing keyboard 16. A wave form of the musical tone to be generated is generated by a neural network. Namely, in this electronic keyboard type musical instrument the musical tone wave form (plotted amplitude level train) is generated by the neural network. For software configuration of the neural network, a CPU 10 is used. Inter-neuron synapse weights are stored in a memory. The CPU 10 which is designated to perform neural network operation and control, a ROM 12 which stores control program, and a RAM 13 which stores synapse weights are connected through a bus 11, through which data is transmitted and received. The tone generator 14, a function switch group 15, a keyboard 16, a display 17, and a wave form inputting device 18 are connected to the bus 11. The tone generator 14 has several tone generating channels which can operate individually. It generates musical tone whose pitch is specified by the keyboard 16. A sound system 19 is connected to this tone generator 14. The musical tone generated by the tone generator 14 is amplified and outputted from a speaker. The function switch group 15 has a wave form number inputting means, a vector specifying means, a preset mode switch, a learning mode switch, and a registration mode switch. The keyboard 16 has 61 (5 octaves) keys. The display 17 consists of a liquid crystal matrix indicator which displays specified vector value and wave form. The wave form inputting device 18 is a sampling device which converts the musical tone wave form inputted from a microphone into PCM (Pulse Coded Modulation) which is stored in a memory.

Figure 2B:
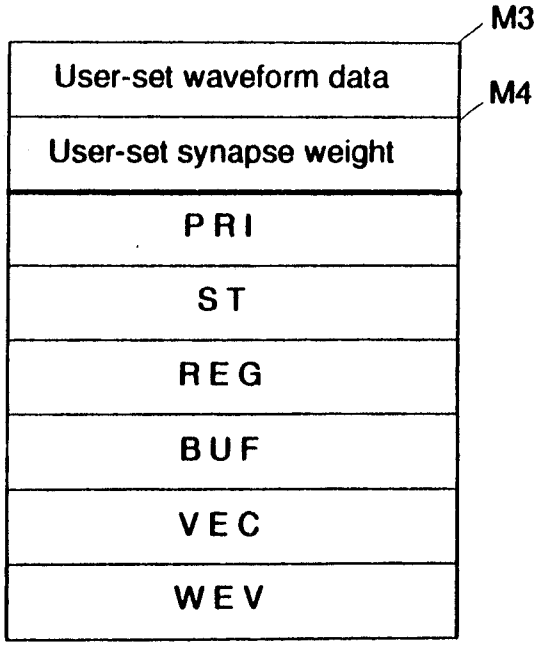
FIG. 2(B) shows a partial configuration of the RAM of the control section.
Figure 2:
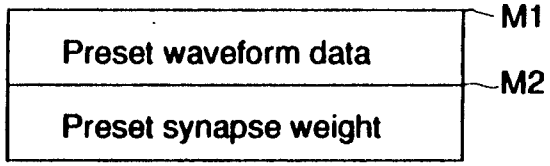
FIG. 2(A) shows a partial configuration of the ROM of the control section.

FIG. 2 (A) shows a partial configuration of the ROM 12. M1 is a preset wave form memory area, and M2 is preset synapse weights memory area. The preset wave form and the preset synapse weights are stored in advance in these memory areas. When the player enters a wave form number in the preset mode, a pertinent wave form is read from the preset wave form memory area, and sent to the tone generator 14. When the player enters a vector value in the preset mode, the CPU 10 performs neural network operation to determine the output pattern based on the preset synapse weights and outputs data.

FIG. 2 (B) shows a partial configuration of the RAM 13. M3 is a user-set wave form memory area, and M4 is a user-set synapse weights memory area. The wave form data and the synapse weights to be stored in these areas are written by the user of the electronic musical instrument.

The following flags and registers are set in the RAM 13.

PRI: Preset Mode Flag: Flag to be set in the preset mode.

ST: Learning Mode Flag: Flag to be set in the learning mode.

REG: Registration Mode Register: Flag which is set when a sampling wave form is inputted from the wave form inputting device 18 and is reset when this wave form is stored in the specified user-set wave form memory area.

BUF: Wave form Buffer: Buffer which stores temporarily the wave form which is sampled by the wave form inputting device 18.

VEC: Input Vector Register: Register which stores temporarily the vector value inputted from the vector specifying means.

WEV: Wave form Number Register: Register which stores temporarily the wave form number inputted from the wave form number inputting means.

Figure 3:
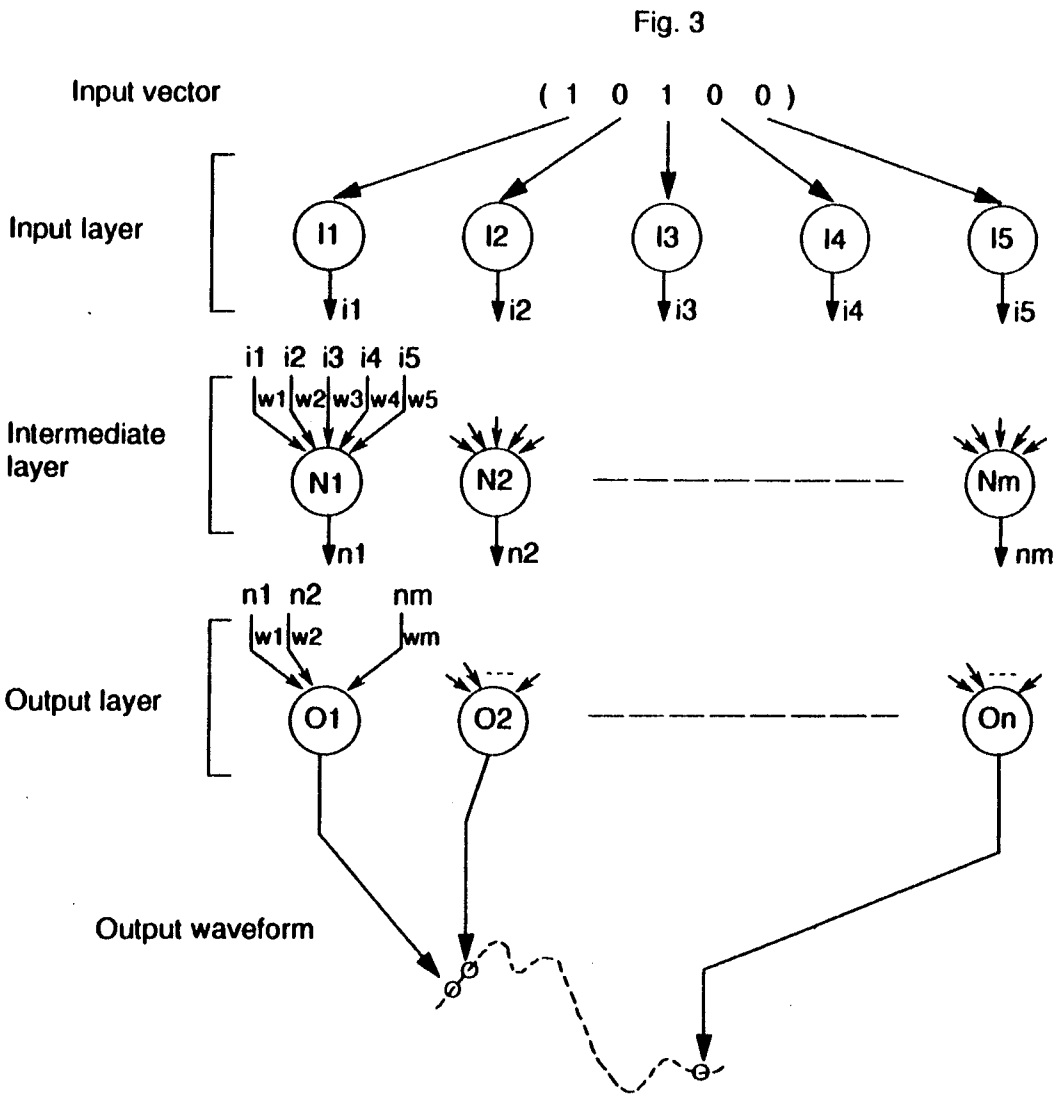
FIG. 3 shows a configuration of a neural network which is arranged in this control section.

FIG. 3 shows a concept of the neural network. This neural network is a hierarchy neural network. It comprises an input layer, an intermediate layer and an output layer, each of which consists of several neurons. The input layer consists of 5 neurons, I1 to I5. It can accept five dimensions vector (input pattern), each term of the vector may be any real number. Tone color image data can be used as the vector. Each neuron of the input layer is synapse-jointed to all neurons of the intermediate layer. The joint strength is determined by synapse weights w. The intermediate layer consists of m neurons N1 to Nm, and each neuron is synapse-jointed to all neurons of the output layer. The output layer consists of n neurons O1 to On, and each neuron corresponds to the amplitude of each timing of the musical tone wave form. Namely, the musical tone wave form can be formed by plotting the output value of the specific each neuron O1 to On in time series.

Figure 4:
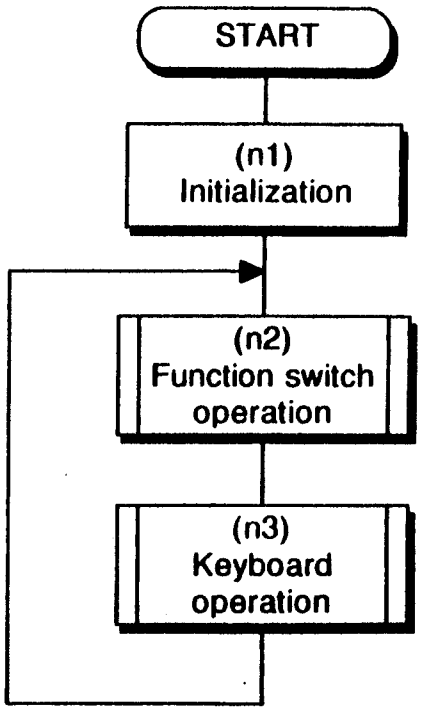
FIGS. 4 (A) to (F) are flow charts showing the operation of the control section.
Figure 4:
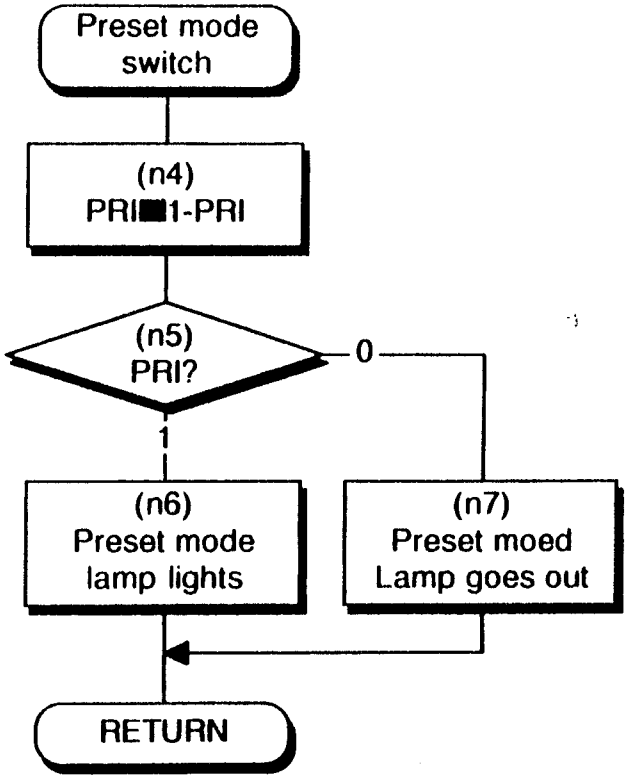
Figure 4:
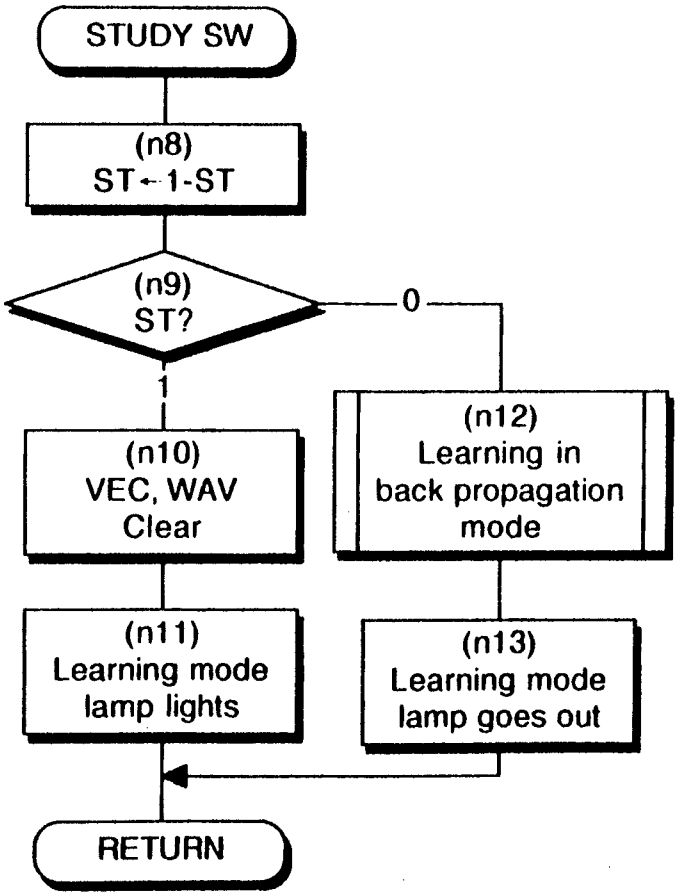
Figure 4:
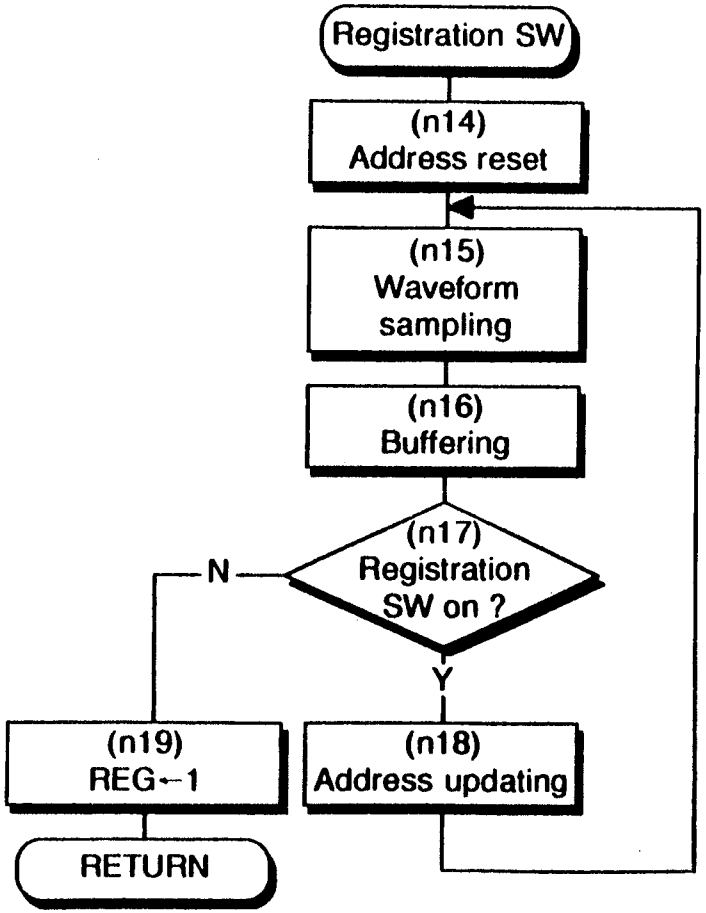
Figure 4:
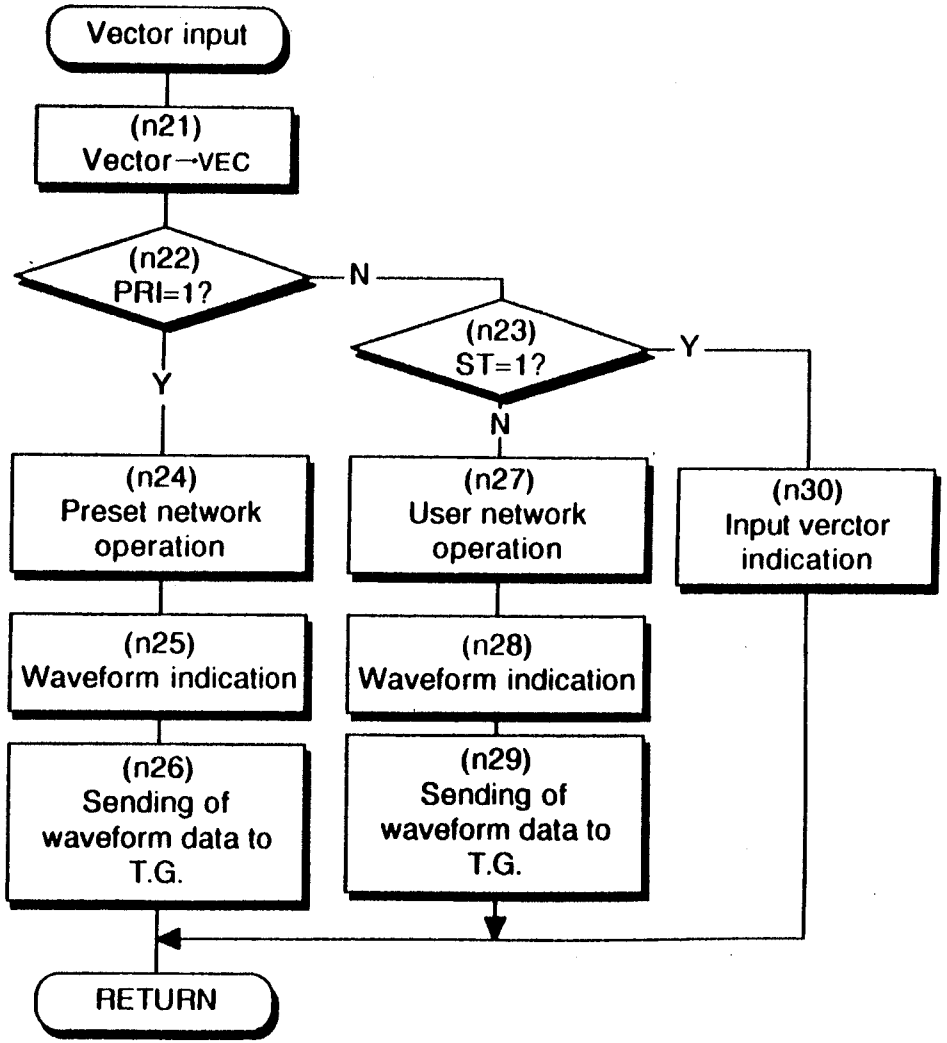
Figure 4:
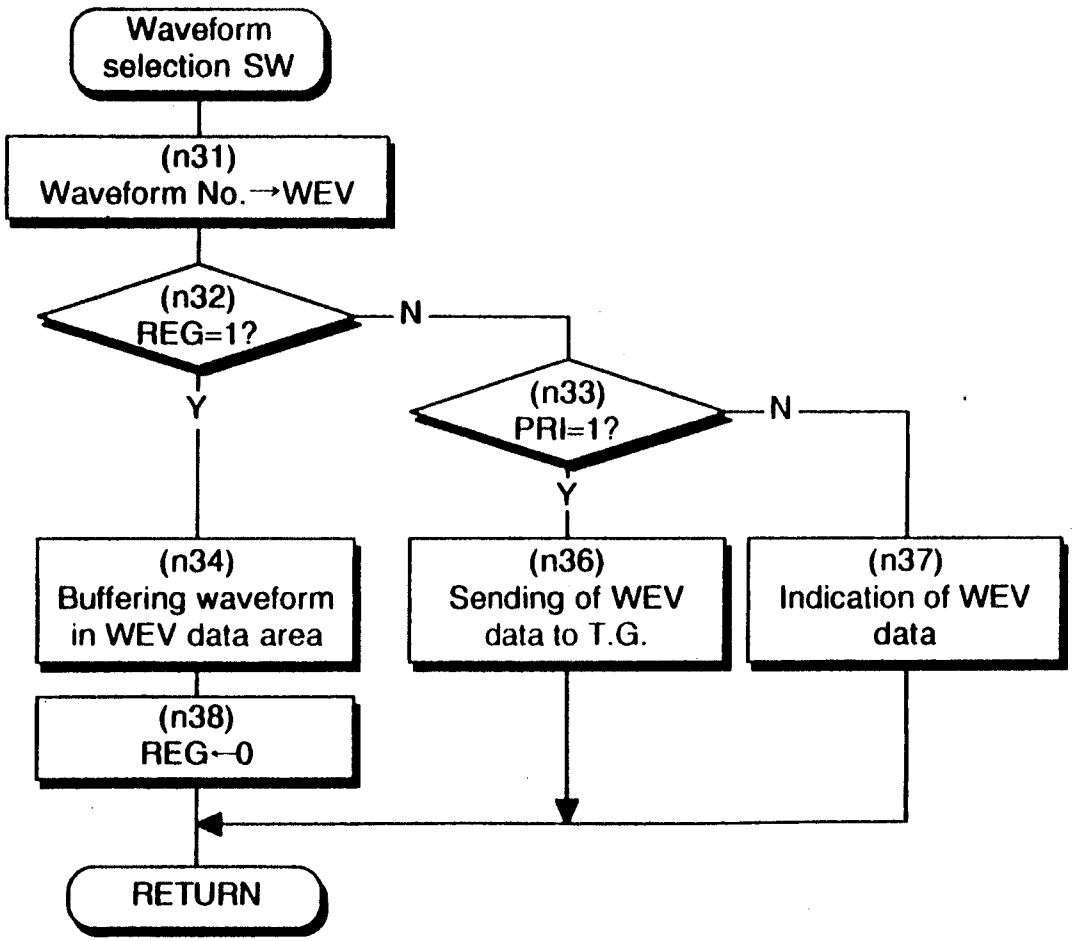

FIGS. 4 (A) to (F) are flow charts showing the operation of the control section. FIG. 4 (A) shows a main routine. In this main routine, at first initializing such as register reset, etc. is performed after power turning-on (n1), so that the electronic musical element is made ready to play. Then, the function switch and the keyboard operations are detected to execute the corresponding processing (n2, n3).

FIG. 4 (B) shows the preset mode switch ON event operation. When the preset mode switch is turned on, the preset mode flag PRI is inverted (n4). If PRI is set as a result of this inversion, the preset mode lamp is lit since the current mode is the preset mode to specify the wave form with the aid of data such as preset (stored in The ROM12) synapse weights, etc. (n6). In the case when PRI is reset, the preset mode lamp is turned off (n7), since the current mode is the user-set mode where the user uses the learnt data.

FIG. 4 (C) shows the learning mode switch ON event operation. This learning mode switch is operated when the relation between the vector and the output wave form is taught to the neural network. When the learning mode switch is turned on, the learning mode flag ST is inverted (n8). If ST is set as a result of this inversion, the learning mode is started. Therefore, the vector register VEC and the wave form number register WAV are cleared (n10), the learning mode lamp is lit (n11), and then the process returns. If ST is reset as a result of inversion, teaching to the neural network is executed by making the vector value stored in VEC to correspond to the wave form data of wave form number stored in WAV (n12). Accordingly, the vector value is an input pattern and the wave form data is an expected output pattern corresponding to this input pattern. These data, the vector value and the wave form data, are set in the registers VEC and WAV as described later in FIG. 4 (E) and FIG. 4 (F). The wave form data includes, for example, an attack part, a sustain part, and a decay part of the wave form of a piano tone. In the learning mode, the neural network is learned as follows.

First, a vector value and a wave form data corresponding to the attack part are inputted and set into the above registers VEC and WAV. Therefore the learning process is performed.

Second, a vector value and a wave form data corresponding to the sustain part are inputted and set, therefore the learning process is performed.

Third, a vector value and a wave form data corresponding to the decay part are inputted and set, therefore the learning process is performed.

According to the such learning process, a smooth varying piano tone is simulated by gradual varying of the vector value.

The above learning process is executed according to the back propagation system. After that the learning model lamp is turned off (n13), and the process returns.

FIG. 4 (D) shows registration switch ON operation. This is an operation to sample the musical tone wave form from the wave form inputting device 18. When the registration switch is turned on, this operation is started. It is repeatedly executed while the switch is kept turned on. At first, at step n14 the address to specify the area of the wave form buffer is reset. Buffer data read/write operation is executed according to this address. Then, the musical tone data (instantaneous value) of specific timing is fetched from the wave form inputting device 18, and this data is stored in the buffer (n16). After that, a judgment as to whether or not the registration switch is ON is executed (n17). If this switch is ON, the address is updated (n18), and the process returns to the step n15. If the registration switch is OFF, sampling is ended. Namely, the process proceeds from the step n17 to the step n19, the registration model flag REG is set, and then the process returns.

FIG. 4 (E) is a flow chart showing the processing when the vector number is inputted. When the vector number is inputted, this value is stored in the input vector register VEC (n21), and a judgment as to whether the preset mode flag PRI and the learning mode flag ST have been set or reset is executed (n22, n23). If PRI has been set, the process proceeds from step n22 to step n24 where the wave form data is calculated by the neural network using the preset synapse weights and this vector value. This wave form is indicated (n25), and at the same time the wave form data is sent to the tone generator 14 (n26). If the learning model flag ST has been set, the vector to be learnt is regarded to have been inputted. This vector is indicated on the display 17, and the process returns (n30).

If both the PRI and the ST have been reset, the process proceeds to step n27 where the musical tone wave form data is calculated by the neural network using the user-set synapse weights. The wave form is indicated on the display 17 (n28) and sent to the tone generator (n29).

FIG. 4 (F) is a flow chart showing the operation which is executed when the wave form selection witch is set to ON. When the wave form selection switch is set to ON, ON wave form number is stored in the wave form number register (n31), and a judgment as to whether the registration mode flag REG and the preset model flag PRI have been set or reset is performed (n32, n33). If the REG has been set, the wave form data stored currently in the wave form buffer BUF is registered in the user-set wave form data memory area (n34). The registration area is an area identified by wave form number (WEV). After the REG is reset (n35), and the process returns.

If the PRI has been set, the wave form data stored in the area which is identified by the wave form number (WEV) in the preset wave form data memory area is sent to the tone generator 14 (n36). The musical tone is generated by this wave form data.

If both the REG and the PRI have been reset, data of the WEV is indicated on the display (n37), and the process returns. This operation is performed when the wave form is selected in the learning mode.

Thus, this electronic musical instrument features that since the input pattern and the expected output are learnt to the neural network in specific conformance, any value of the musical tone parameter other than that stored previously in memory can be got freely, delicate change of the musical tone parameter can be obtained thereby enhancing the expression. Moreover, since there is no need to store many parameters in memory, memory can be saved.

The above-mentioned electronic musical instrument has been designed so that the musical tone parameter pattern is generated through the neural network for the wave form data. The same processing can be performed also for other musical tone parameters.

Figure 5:
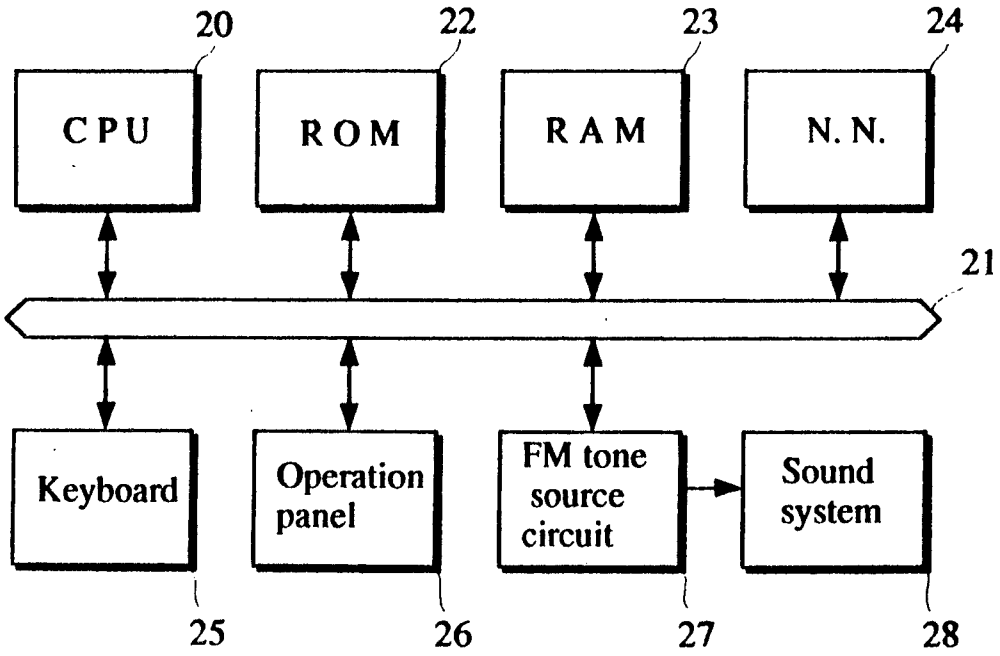
FIG. 5 is a block diagram of control section of an electronic musical element which is another embodiment of the invention.

FIG. 5 is a block diagram showing the control section of an electronic musical instrument which is an another embodiment of the invention. This electronic musical instrument is controlled by a CPU 20 and generates a musical tone according to operation of a player. The CPU 20 is connected to specific circuit through a bus 21. The provided circuits comprises a ROM 22, a RAM 23, a neural network (NN) 24, a keyboard 25, an operation panel 26, and a FM sound tone circuit 27. A sound system 28 designed to amplify the generated musical tone and output it through a speaker, etc. is connected to an FM tone source circuit 27.

Figure 6:
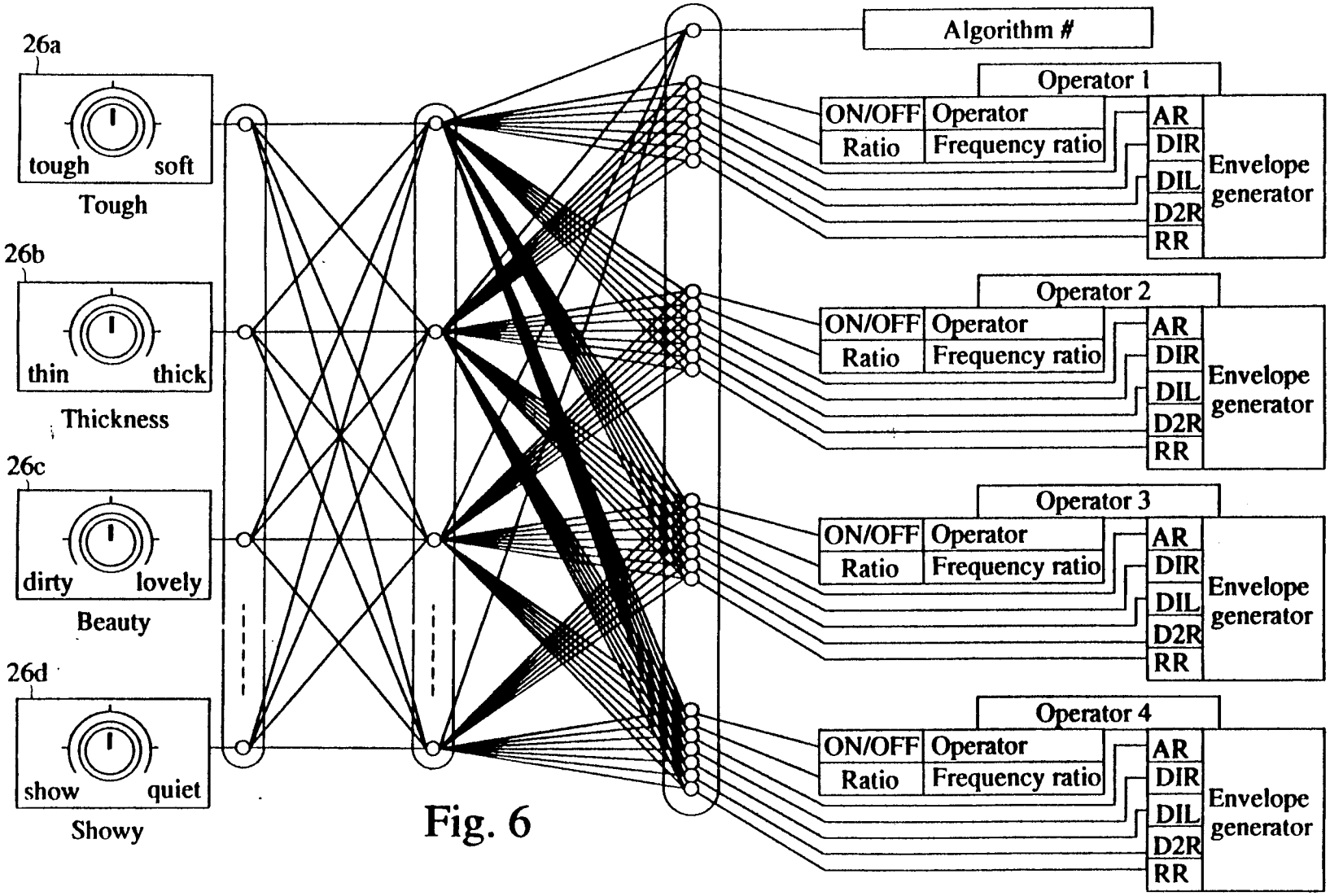
FIG. 6 shows a configuration of a neural network which is used in the control section.

The ROM 22 stores a program and preset synapse weights. The RAM 23 has registers to store various data which are created during playing and stores the synapse weights which is obtained as a result of learning by user. The neural network 24 has a function to decide the wave form specifying parameter int eh FM tone source based on an inputted image parameter. This neural network 24 is a hierarchy neural network as shown in FIG. 6. The image parameter is inputted into an input layer from tone color image specifying dials 26*a* to 26*d*. The wave form specifying parameter as shown in FIG. 6 is outputted to an output layer according to inference based on this parameter. Any hardware configuration is applicable for the neural network provided that the hierarchy inference as shown in the figure is possible. The keyboard 25 is for playing and covers tone range of about 5 octaves. The operation panel 26 has a learning mode/normal mode selection switch, a synapse weights selection switch in addition to the above-mentioned tone color image specifying dials 26*a* to 26*d*. The learning mode is a mode in which an image for the currently set wave form specifying parameter is inputted with the aid of the tone color image specifying dials so that the tone color is learnt. The normal model is an ordinary play mode. The synapse weights selection switch is a selection switch to specify use of the synapse weights which are previously stored in the ROM 22 or use of synapse weights which are learnt in the above-mentioned learning mode and stored in the RAM 23.

The FM tone source circuit 27 is a circuit which specifies generation contents of 4 or 6 operators by settings several parameters, synthesize the musical tone according to the specified algorithm which designates the combination of operators and modification procedure. By properly adjusting the parameters and algorithm, complex changed tone colors and high-order harmonic overtones can be obtained. The parameters and the algorithm are set by the CPU 20 before playing. The musical tone of specific pitch is generated based on a key-ON signal and a key code sent from the CPU 20 during playing.

FIG. 6 shows an outline of the tone color image specifying dials 26*a* to 26*d*, as well as an outline of the neural network 24. The tone color image specifying dials 26*a* to 26*d* can set the extent of 4 types of tone color image. The dial 26*a* specifies hardness of tone (hard/soft). The dial 26*b* specifies tone thickness (thick/thin). The dial 26*c* specifies beauty of tone (beauty/dirt). The dial 26*d* specifies showiness of tone (showy/quiet). A value which is specified by the tone color image specifying dials 26*a* to 26*d* is inputted into the neural network 24 as image parameter. These 4 image parameters are inputted into the input layer of the neural network 24. Each neuron of the input layer and a joint layer is synapse-jointed with specific weighing, and each neuron of the joint layer and the output layer is also synapse-jointed with specific weighting. An output of specific neuron of the output layer corresponds to the wave form specifying parameter of specific operator and algorithm. For simpler explanation, FIG. 6 shows an operator ON/OFF, a frequency ration (pitch of musical tone to be generated with respect to frequency) and an envelope rate as the wave form specifying parameters of each operator. The real operator is specified by more parameters including musical effect parameter, such as a vibrato rate or a portamento. This output is sent to the FM tone source circuit 27 through the CPU 20, and the FM tone source circuit 27 generates the musical tone according to this parameter.

This neural network 24 learns previously several teach data. Proper output parameter can be set according to this learning irrespective of what parameter is inputted. Statistic data of unspecified many players are used as the teach data. The neural network is learnt so that it outputs the wave form specifying parameter which makes the FM tone source circuit 27 generate the musical tone suited to specified image by the tone color image specifying dial 26. This simplifies greatly tone generation.

Several sets of learnt the synapse weights to be stored in the RAM 23 applied in the above electronic musical instrument are applicable. Data of the musical tone to be learnt is allowed to be not the wave form specifying parameter which has been set in the electronic musical instrument but be data inputted from other equipment.

The musical tone generating device of this invention can generate the musical tone, using the neural network, so that the musical tone suited to image can be generated easily without operating complicated parameters. This simplifies, for example, a tone color edit of the FM tone source circuit.

The third embodiment of the invention is explained below by referring to FIG. 7 and FIG. 8.

Figure 7:
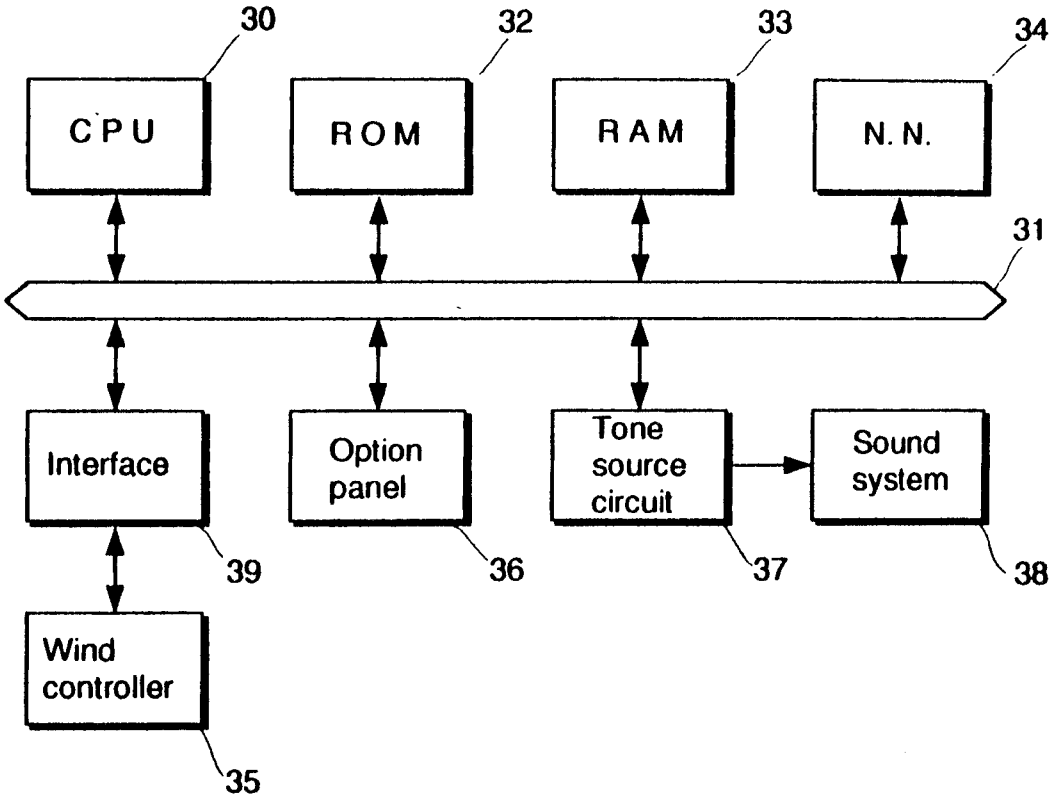
FIG. 7 is a block diagram of control section of an electronic musical instrument which is also an embodiment of the invention.

FIG. 7 is a block diagram which shows a control section of the electronic musical instrument which is the 3rd embodiment of the invention. This electronic musical instrument is provided with a wind instrument type playing device (wind controller) 35 (see FIG. 8). It generates musical tone when a player blows. The whole operation is controlled by a CPU 30. The CPU 30 is connected to a ROM 32, a RAM 33, a neural network (NN) 34, an interface 39, an operation panel 36 and a harmonics additive type tone source circuit 37 through a bus 31. The above-mentioned wind controller 35 is connected to the interface 39. A sound system 38 to amplify a generated musical tone and to output it from a speaker is connected to a tone source circuit 37.

An operation control program and synapse weights corresponding to a musical instrument name chosen by the player are stored in the ROM 32. When the player chooses a musical instrument name, synapse weights corresponding thereto are read from this ROM 32 and set in the neural network 34. Several registers to store various data generated during playing are provided in the RAM 33. The neural network 34 executes an inference so as to decide a musical tone which must be generated according to the ON/OFF pattern of a key system 41 (see FIG. 8) of the wind controller 35. This neural network 34, as outlined in FIG. 8, is an hierarchy neural network. The ON/OFF signal of each key is inputted into each neuron of the input layer, and a frequency control signal of the harmonics to be synthesized and its amplitude control signal are outputted from the output layer. It is possible to use the neural network of any hardware configuration provided that the hierarchy inference as shown in the figure is feasible. Moreover, the Neumann type microprocessor is applicable if high speed inference processing is possible.

Figure 8:
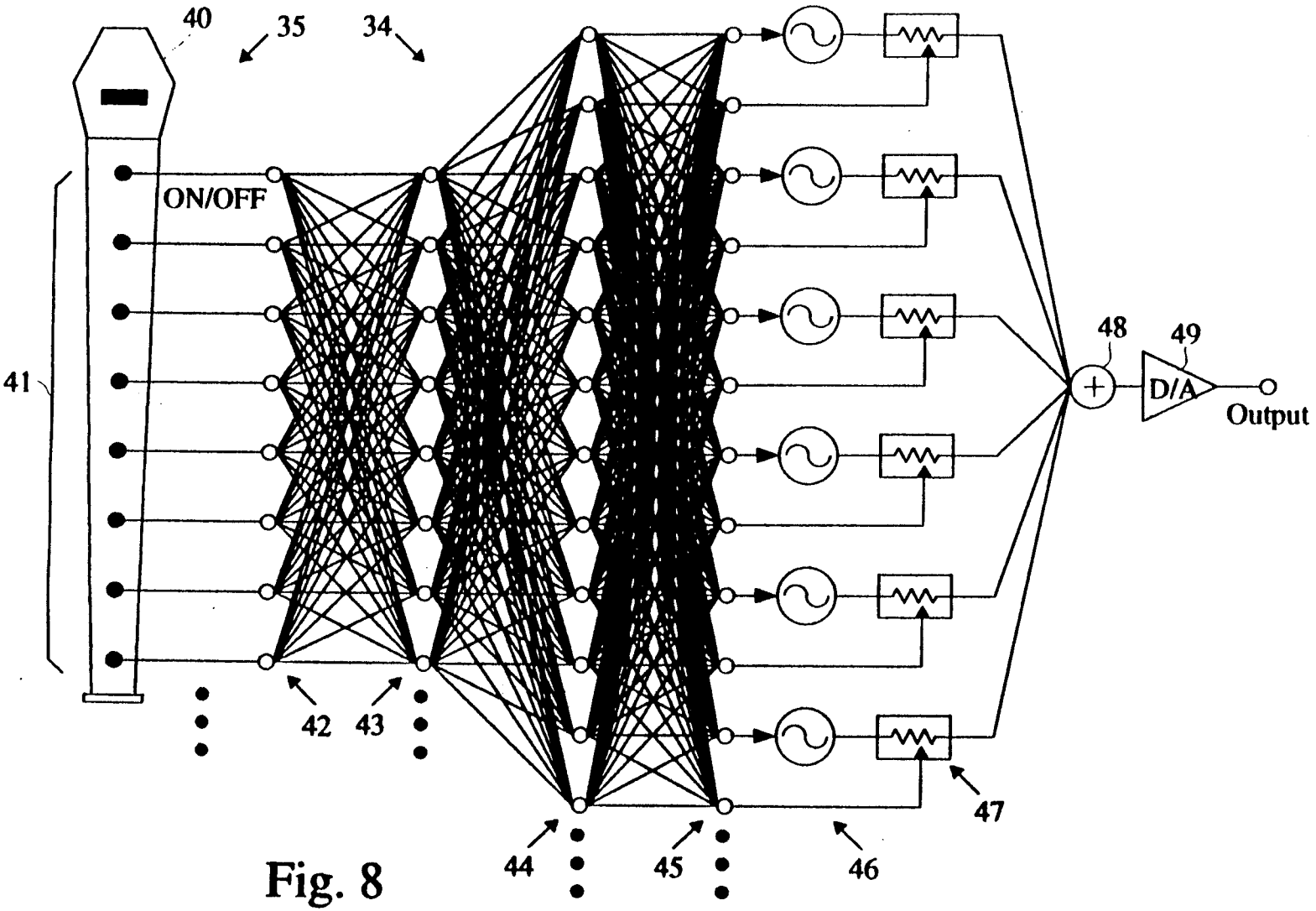
FIG. 8 shows an approximate configuration of a playing unit, a neural network and a tone source circuit of the electronic musical instrument.

The wind controller 35, as shown in FIG. 8, is a wind musical instrument (recorder) type playing device. It controls tone generation/silencing and tone generation level according to an intensity of breath blown into a mouthpiece 40. The key system 41 is controlled by fingers of both hands of the player. The pitch of musical tone to be generated is decided by ON/OFF pattern of the key system 41. The operation panel 36 is provided with a tone color selection witch and a display. Tone source circuit 37 which is harmonics additive type is a tone source circuit which generates musical tone by adding sine waves of different frequencies to synthesize (generate) the musical tone as shown in FIG. 8 (right). Frequency and amplitude of the sine waves to be synthesized are inferred by the neural network 34.

FIG. 8 shows the approximate configuration of the wind controller 35, the neural network 34 and the tone source circuit 37 of the electronic musical instrument. The wind controller 35 has a shape similar to that of the wind instrument as shown in the figure. The player blows in breath from the mouthpiece 40, and controls the key system 41 with his fingers of both hands to play the instrument. Each key composing the key system 41 is an electronic switch. The ON/OFF signal caused by operation is given to the input layer 42 of the neural network 34 as an electric signal. The neural network 34 is a hierarchy neural network having 4 layers, namely an input layer 42, a 1st intermediate layer 42, a 2nd intermediate layer 44, and an output layer 45. The input layer 42 has the same number of neurons as the key system 41 and is connected to the 1st intermediate layer 44, with specific synapse weights. The 1st intermediate layer 44 and the 2nd intermediate layer 45 are also mutually connected with specific synapse weights, and the 2nd intermediate layer 44 and the output layer 45 are also mutually connected with specific synapse weights. The number of neurons of the output layer 45 is equal to the number of sine wave generating circuits 46 of the tone source circuit 37, or the number of distributors 47 of the tone source circuit 37. Each neuron of the output layer 45 outputs the frequency control signal of the sine wave to be generated to the sine wave generating circuit 46 and at the same time outputs a distribution rate (amplitude) control signal of the inputted sine wave to the distributor 47. The tone source circuit 37 comprises the above-mentioned sine wave generating circuit 46, the distributor 47, an adding circuit 48, and a ED/A converter 49. The sine wave generated by the sine wave generating circuit is restricted to the specified amplitude value by the distributor 47, and the restricted signal is inputted into the adding circuit 48. In the adding circuit 48 all the inputted sine waves are added to synthesize, and the obtained signal is inputted into the D/A converter 49. In the D/A converter 49 the inputted synthesis signal is shaped to give smooth envelop, and then the shaped signal is outputted. The outputted signal is the musical tone signal which is amplified by the sound system 38 and outputted herefrom.

Because the harmonics synthesis type tone source circuit is controlled by the neural network to generate the musical tone, it is possible to use the result of analysis by FFT (Fast Fourier Transformer) as teach pattern of the neural network. That is, musical tone of specific pitch of the musical instrument to be learnt is FFT-analyzed, and the result of FFT, to which the ON/Off pattern to generate the FFT-analyzed musical tone corresponds, is given to the neural network as the teach pattern. As above learning is performed for the whole tone range, it becomes possible to infer properly the musical tone of the whole tone range with one set of synapse weights.

The applicable tone source circuit is not restricted to the harmonics synthesis tone source circuit. FM tone source is also applicable. In this case the neural network outputs FM parameters specifying the music tone such as key level scaling parameter which enables operators of the FM tone source to vary generating sine wave according to a turned on key data (pitch data). And in this case the learning mode is performed by using pitch data and the key level scaling parameter.

It is allowed to include a blow intensity detected at the mouthpiece 40 in the input variables of the neural network 34. This makes it possible to infer simultaneously a change of tone color depending on the tone generation level.

Thus, this electronic musical instrument makes it possible to infer not only the pitch of the musical tone but also the tone color based on the ON/OFF pattern of several play keys. This enables the player to variegate the musical tone depending on the pitch similarly to the natural musical instrument, which enhances the expression of the electronic musical instrument.

What is claimed is:

1. An electronic musical instrument for generating a musical tone signal comprising:

memory means for storing a plurality of waveform data and a plurality of synapse weight data corresponding to the plurality of waveform data;

selection means for selecting one of the plurality of waveform data;

input means for inputting an input data;

electronic neural network means having a plurality of neurons, each of which is synapse-jointed to other neurons at a joint strength based on a plurality of synapse weight data, the neural network means for calculating waveform data corresponding to the input data based on the selected waveform data and the synapse weight data corresponding to the selected waveform data; and tone generation means for generating a musical tone signal based on the waveform data calculated by the electronic neural network means, wherein the electronic neural network means generates waveform data which is not stored in the memory means as well as waveform data which is stored in the memory means, in response to the input data.

2. An electronic musical instrument according to claim 1, wherein the input means includes a keyboard and the input data represents key information.

3. An electronic musical instrument according to claim 1, further including waveform inputting means for inputting inputted waveform data, and wherein the neural network means calculates synapse weight data corresponding to the inputted waveform data and the memory means stores in the inputted waveform data and the calculated synapse weight data which is used as a user-set waveform data and a plurality of user-set synapse weight data corresponding to the user-set waveform data.

4. An electronic musical instrument comprising:

first memory means for storing preset synapse weight data;

user setting means for setting user-set synapse weight data;

second memory means for storing the user-set synapse weight data;

input means for inputting input data;

electronic neural network means for calculating output waveform data based on synapse weight data, said electronic neural network means having a plurality of neurons each of which is synapse-jointed to other neurons at a joint strength determined by synapse weight data;

selection means for applying to the electronic neural network means either the preset synapse weight data stored in the first memory means or the user-set synapse weight data stored in the second memory means so that the output waveform data calculated by the neural network means is based either on the preset synapse weight data or the user-set synapse weight data; and tone generator means for generating a musical tone signal in response to the input data and the output waveform data calculated by the electronic neural network means.

5. An electronic musical instrument according to claim 4 wherein the first memory means stores preset waveform data, the user setting means sets user-set waveform data, the second memory means stores the user-set waveform data and the selection means applies to the tone generator means the preset waveform data, the user-set waveform data or the output waveform data calculated by the electronic neural network means.

6. An electronic musical instrument according to claim 4 wherein the electronic neural network comprises a central processing unit.

7. An electronic musical instrument for generating a musical tone signal, comprising:

tone generation means having a plurality of operators each of which generates a waveform based on a waveform determination parameter, the tone generation means for generating a musical tone signal by combining at least one of the plurality of operators based on an algorithm;

inputting means for inputting an image parameter representing a tone color characteristic of a musical tone signal to be generated;

electronic neural network means having a plurality of neurons, each of which is synapse-jointed to other neurons at a joint strength based on a plurality of synapse weight data, the electronic neural network means for calculating waveform determination parameters and an algorithm corresponding to the inputted image parameter based on the plurality of synapse weight data; and the tone generation means for generating a musical tone signal based on the calculated waveform determination parameters and algorithm corresponding to the inputted image parameter.

8. An electronic musical instrument according to claim 7 wherein the image parameter expresses at least one of hardness of tone, thickness of tone, beauty of tone and showiness of tone.

9. An electronic musical instrument according to claim 7 wherein the tone generation means is a frequency modulation device.

10. An electronic musical instrument for generating a musical tone signal, comprising:

inputting means for inputting key information representing at least one of key on and key off;

tone pitch determination means for determining a tone pitch of a musical tone to be generated based on a key on/key off pattern inputted by the inputting means;

electronic neural network means having a plurality of neurons, each of which is synapse-jointed to other neurons at a joint strength based on a plurality of synapse weight data, the electronic neural network means for calculating data to determine a waveform of a musical tone to be generated, based on the plurality of synapse weight data; and tone generation means for generating a musical tone signal having a tone pitch determined by the tone pitch determination means and a waveform determined by the calculated data, wherein the electronic musical instrument changes a tone color as well as a tone pitch of a musical tone signal to be generated, in response to the inputted key information.

11. An electronic musical tone instrument according to claim 10, wherein the inputting means includes a wind instrument type key system.

12. An electronic musical instrument according to claim 10 wherein the tone generation means is a harmonics additive-type tone source circuit.

* * * * *